US011048186B2

(12) United States Patent
Yamauchi

(10) Patent No.: US 11,048,186 B2
(45) Date of Patent: Jun. 29, 2021

(54) IMAGE FORMING APPARATUS

(71) Applicant: KYOCERA Document Solutions Inc., Osaka (JP)

(72) Inventor: Hironori Yamauchi, Osaka (JP)

(73) Assignee: Kyocera Document Solutions, Inc.

( * ) Notice: Subject to any disclaimer, the term of this patent is extended or adjusted under 35 U.S.C. 154(b) by 0 days.

(21) Appl. No.: 16/905,786

(22) Filed: Jun. 18, 2020

(65) Prior Publication Data

US 2020/0401063 A1 Dec. 24, 2020

(30) Foreign Application Priority Data

Jun. 21, 2019 (JP) ..... JP2019-115914

(51) Int. Cl.
*G03G 15/043* (2006.01)

(52) U.S. Cl.
CPC ..... *G03G 15/043* (2013.01)

(58) Field of Classification Search
CPC ..... G03G 15/043
See application file for complete search history.

(56) References Cited

FOREIGN PATENT DOCUMENTS

JP H01-297270 11/1989

*Primary Examiner* — G. M. A Hyder

(57) ABSTRACT

An image forming apparatus includes a photoconductor drum, a charging device, an exposure device, a development device, and an exposure position changing unit. The charging device is configured to charge the photoconductor drum. The exposure device is configured to irradiate the photoconductor drum and thereby form an electrostatic latent image on the photoconductor drum. The development device is configured to cause toner to adhere to the electrostatic latent image on the photoconductor drum in a two-component-development manner. The exposure position changing unit is configured to change, on the photoconductor drum, an exposure position of the exposure device to a position getting close to the development device from an exposure position for print image development when electric power cutoff is detected.

3 Claims, 4 Drawing Sheets

IMAGE FORMING APPARATUS

CROSS-REFERENCE TO RELATED APPLICATIONS

This application relates to and claims priority rights from Japanese Patent Application No. 2019-115914, filed on Jun. 21, 2019, the entire disclosures of which are hereby incorporated by reference herein.

BACKGROUND

1. Field of the Present Disclosure

The present disclosure relates to an image forming apparatus.

2. Description of the Related Art

In an image forming apparatus of a two-component-developer type, when electric power is cut off, if potential of a development device decreases against a photoconductor drum that is in a charging status, then a carrier development (carrier jumping from the development device to the photoconductor drum) may occur. Therefore, when electric power is cut off, an image forming apparatus causes an exposure device to perform fully-continuous lighting and thereby reduces an electric charge amount on the photoconductor drum, and consequently restrains such carrier development.

However, even if such exposure is performed when electric power is cut off, a section from an exposure position (i.e. irradiation position) to a position with the shortest distance to the development device (i.e. development position) on a surface of the photoconductor drum is not exposed with exposure light, and consequently such carrier development may occur when this section reaches to the development position due to inertial rotation of the photo conductor drum.

SUMMARY

An image forming apparatus according to an aspect of the present disclosure includes a photoconductor drum, a charging device, an exposure device, a development device, and an exposure position changing unit. The charging device is configured to charge the photoconductor drum. The exposure device is configured to irradiate the photoconductor drum and thereby form an electrostatic latent image on the photoconductor drum. The development device is configured to cause toner to adhere to the electrostatic latent image on the photoconductor drum in a two-component-development manner. The exposure position changing unit is configured to change, on the photoconductor drum, an exposure position of the exposure device to a position getting close to the development device from an exposure position for print image development when electric power cutoff is detected.

These and other objects, features and advantages of the present disclosure will become more apparent upon reading of the following detailed description along with the accompanied drawings.

DETAILED DESCRIPTION

Hereinafter, an embodiment according to an aspect of the present disclosure will be explained with reference to drawings.

Figure 1:
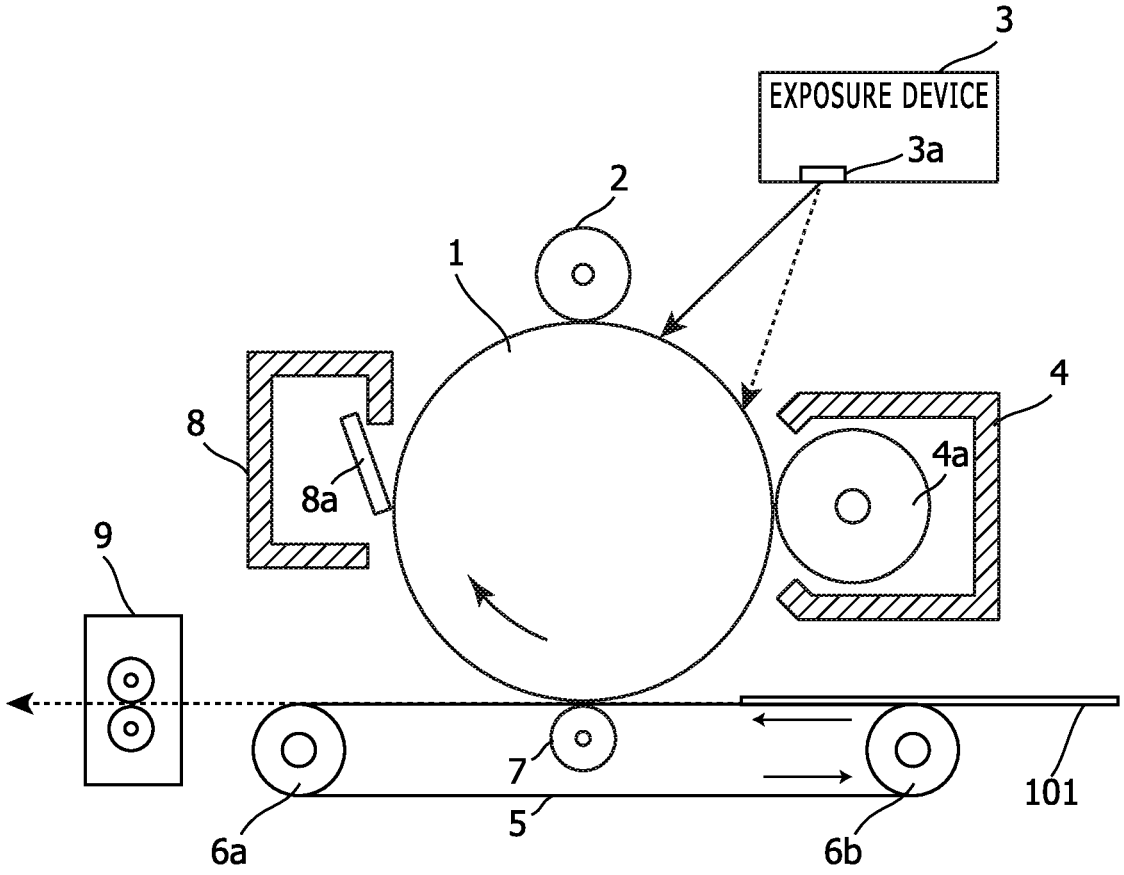
FIG. 1 shows a side view that indicates an internal mechanical configuration of an image forming apparatus in an embodiment according to the present disclosure.

FIG. 1 shows a side view that indicates an internal mechanical configuration of an image forming apparatus in an embodiment according to the present disclosure. The image forming apparatus shown in FIG. 1 is an apparatus that has an electrophotographic printing function, such as a printer, a facsimile machine, a copier or a multi function peripheral.

The image forming apparatus includes a photoconductor drum 1, a charging device 2, an exposure device 3, a development device 4, a transportation belt 5, a driving roller 6*a* and a driven roller 6*b*, a transfer roller 7, a cleaning device 8, and a fuser device 9.

The charging device 2 charges a surface of the photoconductor drum 1 so as to cause the surface to get a predetermined potential.

The exposure device 3 exposes the photoconductor drum using a light source 3*a*, and thereby forms an electrostatic latent image on the photoconductor drum 1. Here, the light source 3*a* is an LED (Light Emitting Diode) head, but alternatively may be an LSU (Laser Scanning Unit).

The development device 4 causes toner to adhere to the electrostatic latent image on the photoconductor drum in a two-component-development manner. For example, the development device 4 includes a development roller 4*a*. The development roller 4*a* keeps two-component developer on a surface thereof. To the development roller 4*a*, a predetermined voltage is applied as a development bias by a bias circuit (not shown). When applying a development bias for ordinary print image development, only toner in the two-component developer gets apart from the development roller 4*a* due to the development bias and adheres to the electrostatic latent image on the photoconductor drum 1. When electric power is cut off, the development bias of the development roller 4 immediately changes to zero volt.

The transportation roller 5 rotates due to a driving force from the driving roller 6*a*, and thereby transports a print sheet 101 to a position between the photoconductor drum 1 and the transfer roller 7.

The transfer roller 7 makes the print sheet 101 contact to the photoconductor drum 1, and transfers a toner image on the photoconductor drum 1 to the print sheet 101.

The cleaning device 8 collects residual toner on the photoconductor drum 1 after transferring the toner image. For example, the cleaning device 8 causes a cleaning blade 8*a* to contact to the photoconductor drum 1, and thereby removes and collects toner on the photoconductor drum 1.

The fuser device 9 fixes the toner image on the print sheet 101, for example, in a heating-and-pressurizing manner.

Figure 2:
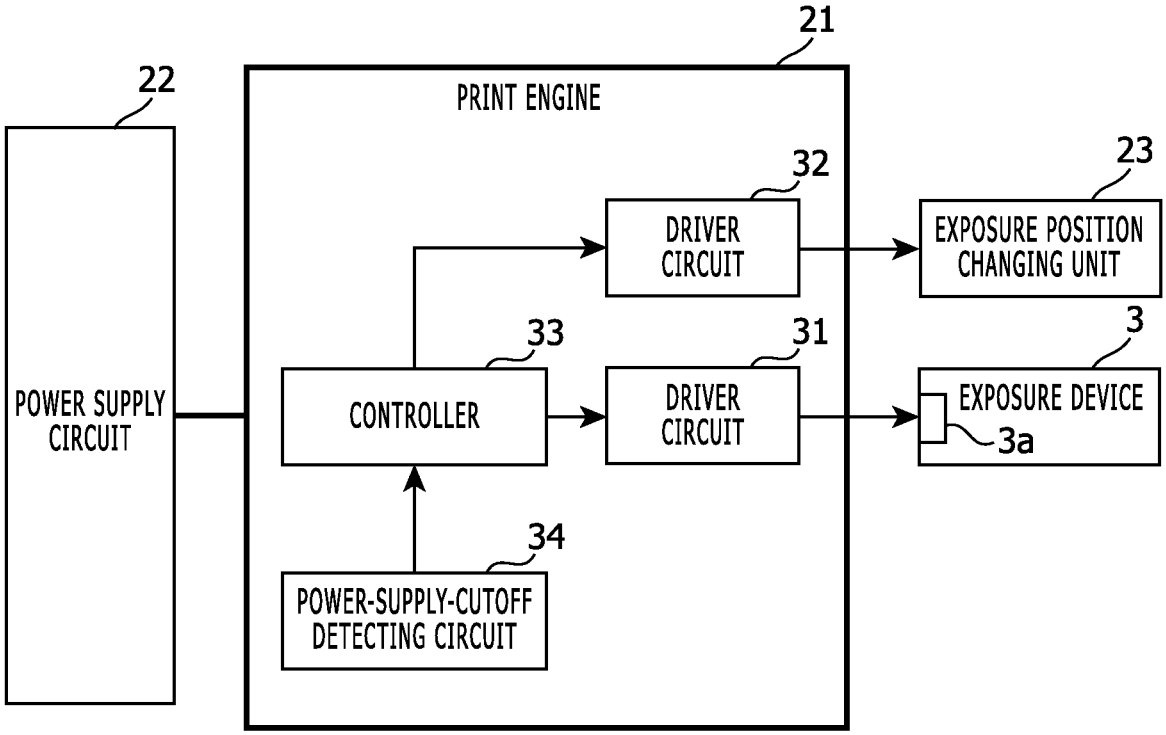
FIG. 2 shows a block diagram that indicates an electronic configuration of the image forming apparatus shown in FIG. 1.

FIG. 2 shows a block diagram that indicates an electronic configuration of the image forming apparatus shown in FIG. 1. As shown in FIG. 2, the image forming apparatus in this embodiment includes a print engine 21, a power supply circuit 22, and an exposure position changing unit 23.

The print engine 21 includes an ASIC (Application Specific Integrated Circuit) of a predetermined specific function, a micro computer, another electronic circuit, and/or the like, and controls the exposure device 3 and the like and thereby performs printing an image. The power supply circuit 22 supplies electric power to the print engine 21 and the like with a predetermined voltage (e.g. 24 volt) on the basis of electric power obtained from commercial power supply.

When electric power cutoff is detected by a power-supply-cutoff detecting circuit 34 mentioned below, the exposure position changing unit 23 changes on the photoconductor drum 1, an exposure position of the exposure device 3 to a position getting close to the development device 4 from an exposure position for print image development.

In this embodiment, the exposure position changing unit 23 changes a position or a direction of the light source 3*a* of the exposure device 3, and thereby changes the exposure position to a position getting close to the development device 4 from an exposure position for print image development.

Figure 3:
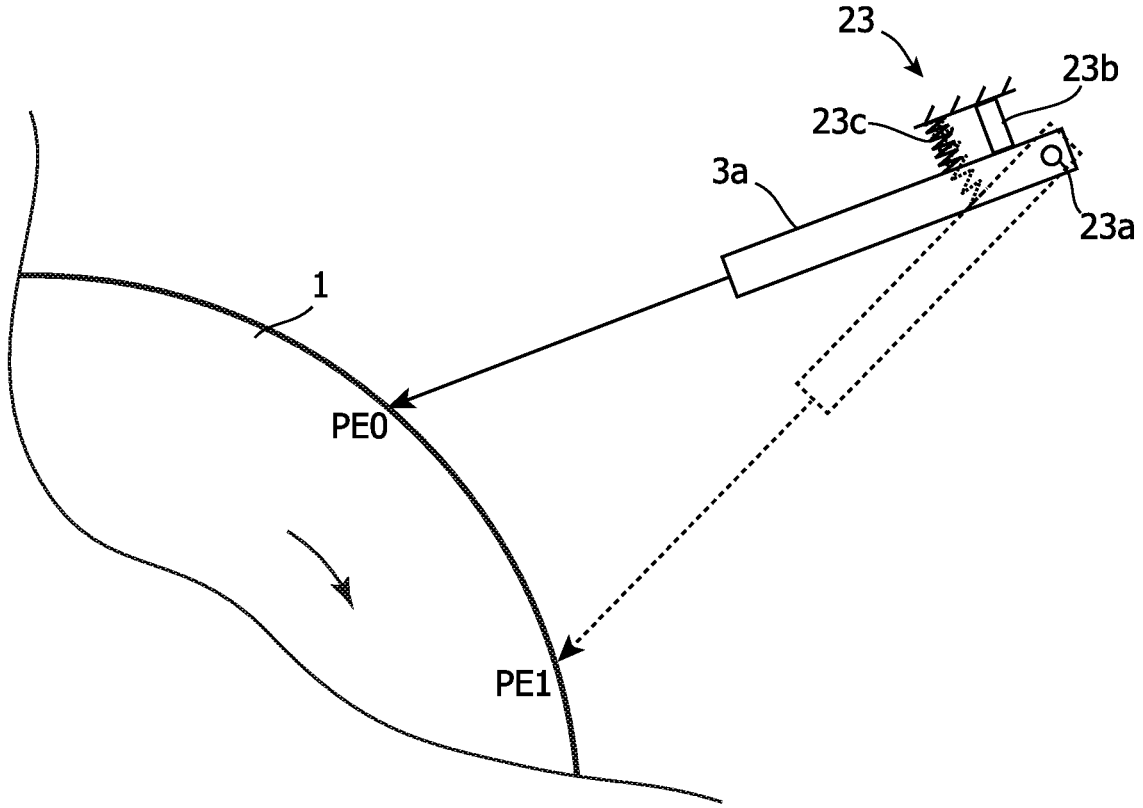
FIG. 3 shows a diagram that indicates an example of an exposure position changing unit 23 shown in FIG. 2.

FIG. 3 shows a diagram that indicates an example of an exposure position changing unit 23 shown in FIG. 2.

For example, as shown in FIG. 3, the exposure position changing unit 23 includes a rotation shaft 23*a* of the light source 3*a*, a solenoid 23*b*, and a spring 23*c*. The solenoid 23*b* provides electromagnetic force to the light source 3*a* such that the direction of the light source 3*a* (i.e. its light emitting direction) gets a predetermined direction for print image development. Here, the light source 3*a* includes a member of a soft magnetic material (e.g. iron) at a position thereon facing to the solenoid 23*b*. When the electric current to the solenoid 23*b* is stopped and the electromagnetic force of the solenoid 23*b* is removed, for example, as shown by a dashed line in FIG. 3, the spring 23*c* causes the light source 3*a* to rotate to the predetermined direction around the rotation shaft 23*a* as a center of the rotation using restoring force of the spring 23*c*.

Thus, when developing a print image, the electric current is caused to flow through the solenoid 23*b* and thereby the direction of the light source 3*a* is set as a predetermined first direction, and consequently, light emitted from the light source 3*a* is incident to a predetermined position PE0 on the photoconductor drum 1. Contrarily, when electric power is cut off, the electric current flow through the solenoid 23*b* is immediately stopped and thereby the direction of the light source 3*a* is set as a predetermined second direction, and consequently, light emitted from the light source 3*a* is incident to a predetermined position PE1 on the photoconductor drum 1 such that the position PE1 gets close to the development position from the position PE0.

The print engine 21 includes driver circuits 31 and 32, a controller 33, and a power-supply-cutoff detecting circuit 34.

The driver circuit 31 drives the light source 3*a* of the exposure device 3. The driver circuit 32 drives the exposure position changing unit 23. The controller 33 controls the driver circuits 31 and 32.

Specifically, the controller 33 (*a*) provides an exposure switching control signal and thereby sets an ON status or an OFF status of the exposure of the exposure device 3 (i.e. light emitting of the light source 3*a*) to the driver circuit 31, and (b) provides an exposure position control signal and thereby sets the exposure position of the exposure device 3 (i.e. a position on the photoconductor drum 1 where light emitted from the light source 3*a* is incident) to the driver circuit 32.

If a power supply voltage of the power supply circuit gets less than a predetermined value, then the power-supply-cutoff detecting circuit 34 detects that power supply cutoff occurs. If the power-supply-cutoff detecting circuit 34 detects power supply cutoff, then the controller 33 sets the ON status of the exposure of the exposure device 3 to the driver circuit 31. The driver circuit 31 turns the light source 3*a* on/off in accordance with the exposure switching control signal. Consequently, this exposure is performed onto a whole printable area.

For example, if the exposure position changing unit 23 is installed as shown in FIG. 3, then the controller 33 (*a*) causes electric current to flow through the solenoid 23*b* using the driver circuit 32 and thereby causes the solenoid 23*b* to provide electromagnetic force to the light source 3*a* such that the direction of the light source 3*a* gets the predetermined direction for print image development, and (b) when electric power cutoff is detected, immediately removes the electromagnetic force by stopping the electric current using the driver circuit 32 and thereby changes the direction of the light source and immediately causes the exposure position to get close to the development device 4.

Figure 4:
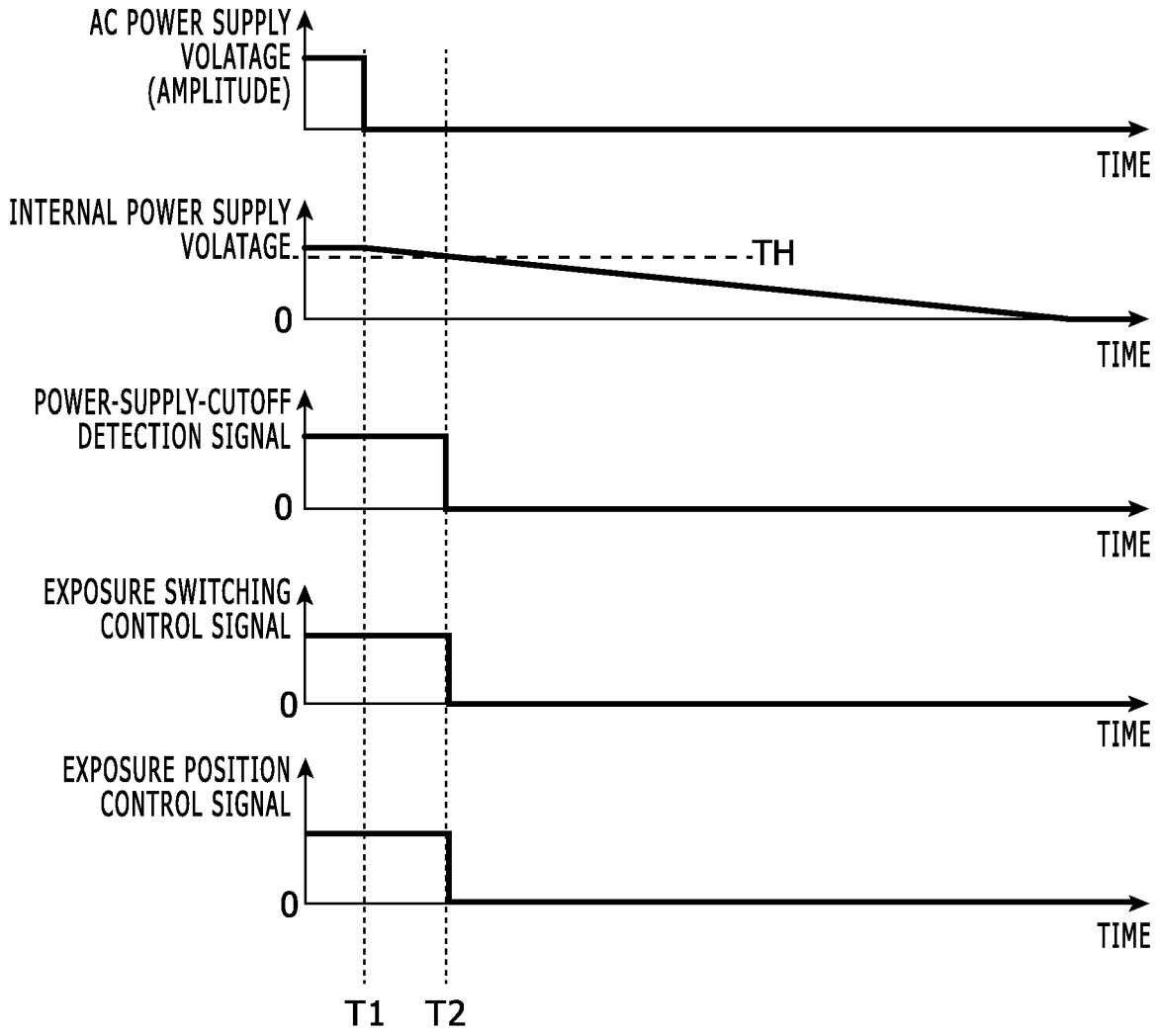
FIG. 4 shows a timing chart that explains a behavior of the image forming apparatus shown in FIGS. 1 and 2.

The following part explains a behavior of the aforementioned image forming apparatus. FIG. 4 shows a timing chart that explains a behavior of the image forming apparatus shown in FIGS. 1 and 2.

At the time T1, if commercial AC power supply cutoff occurs, then an output voltage of the power supply circuit (i.e. DC (direct current) internal power supply voltage) gradually decreases, and when this output voltage gets less than a predetermined threshold value TH, the power-supply-cutoff detecting circuit 34 immediately detects power supply cutoff (at the time T2), and changes a level of a power-supply-cutoff detection signal from HIGH to LOW.

It should be noted that a power supply voltage that enables each element in the print engine 21 (i.e. the controller 33 and the like) to act (e.g. 5 volt or 3.3 volt) is less than the output voltage of the power supply circuit (e.g. 24 volt), and therefore, even at this time point, the print engine 21 continues to act. Power supply for each element in the print engine 21 (i.e. the controller 33 and the like) is (a) power supply provided through voltage conversion from the output voltage of the power supply circuit 22, (b) power supply provided by another power supply circuit, or the like.

If the power-supply-cutoff detection signal gets the LOW level, then the controller 33 activates the exposure position changing unit 23 using the driver circuit 32 and thereby causes the exposure position of the exposure device to get close to the development device 4 in a circumferential direction on a surface of the photoconductor drum 1.

Further, the power-supply-cutoff detection signal gets the LOW level, then the controller 33 changes the exposure switching control signal from the HIGH level to the LOW level. If the exposure switching control signal gets the LOW level, then the driver circuit 31 causes the light source 3*a* of the exposure device 3 to perform continuous lighting.

Consequently, on the surface of the photoconductor drum 1, this exposure at power supply cutoff reduces an unexposed area. In other words, compared with the exposure performed at the position PE0 shown in FIG. 3 when power supply is cut off, the exposure performed at the position PE1 when power supply is cut off decreases a potential (absolute value) of the development position on the photoconductor drum 1 in the inertial rotation in a shorter time (e.g. until the development bias vanishes after the power supply cutoff).

As mentioned, in the aforementioned embodiment, the charging device 2 charges the photoconductor drum 1. The exposure device 3 exposes the photoconductor drum 1 and thereby forms an electrostatic latent image on the photoconductor drum 1. The development device 4 causes toner to adhere to the electrostatic latent image on the photoconductor drum in a two-component-development manner. When electric power cutoff is detected, the exposure position changing unit 23 changes on the photoconductor drum 1, an exposure position of the exposure device 3 to a position getting close to the development device 4 from an exposure position for print image development.

Consequently, on the surface of the photoconductor drum 1, an area without reducing an electric charge amount immediately after power supply cutoff hardly reaches to the development position, and therefore the carrier development is restrained in a short time immediately after the power supply cutoff.

It should be understood that various changes and modifications to the embodiments described herein will be apparent to those skilled in the art. Such changes and modifications may be made without departing from the spirit and scope of the present subject matter and without diminishing its intended advantages. It is therefore intended that such changes and modifications be covered by the appended claims.

For example, while the image forming apparatus of the aforementioned embodiment is a direct-transfer image forming apparatus, the feature of the present disclosure can also be applied to an indirect-transfer image forming apparatus.

Further, while the image forming apparatus in the aforementioned embodiment is a monochrome image forming apparatus, the feature of the present disclosure can also be applied to a color image forming apparatus.

Furthermore, in the aforementioned embodiment, the exposure position is changed by changing the position or the direction of the light source 3*a*. Alternatively, the exposure position may be changed by inserting an optical system (mirror and/or the like) in an optical path between the light source 3*a* and the photoconductor drum 1 in order to change the optical path from the light source 3*a* to the photoconductor drum 1.

What is claimed is:

1. An image forming apparatus, comprising:

a photoconductor drum;

a charging device configured to charge the photoconductor drum;

an exposure device configured to irradiate the photoconductor drum and thereby form an electrostatic latent image on the photoconductor drum;

a development device configured to cause toner to adhere to the electrostatic latent image on the photoconductor drum in a two-component-development manner; and an exposure position changing unit configured to change, on the photoconductor drum, an exposure position of the exposure device to a position getting close to the development device from an exposure position for print image development when electric power cutoff is detected.

2. The image forming apparatus according claim 1, wherein the exposure position changing unit changes a position or a direction of a light source of the exposure device, and thereby changes the exposure position to the position getting close to the development device from the exposure position for print image development.

3. The image forming apparatus according claim 2, further comprising:

a driver circuit configured to drive the exposure position changing unit; and a controller configured to control the driver circuit;

wherein the exposure position changing unit comprises a solenoid configured to provide electromagnetic force to the light source such that the direction of the light source gets a predetermined direction for print image development; and the controller (a) causes electric current to flow through the solenoid using the driver circuit and thereby causes the solenoid to provide electromagnetic force to the light source such that the direction of the light source gets the predetermined direction for print image development, and (b) when electric power cutoff is detected, immediately removes the electromagnetic force by stopping the electric current using the driver circuit and thereby changes the direction of the light source.

* * * * *